US009723911B2

(12) United States Patent
Gueret

(10) Patent No.: US 9,723,911 B2
(45) Date of Patent: Aug. 8, 2017

(54) DEVICE FOR APPLYING A COMPOSITION TO THE EYELASHES OR THE EYEBROWS

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 893 days.

(21) Appl. No.: 13/501,511

(22) PCT Filed: Oct. 15, 2010

(86) PCT No.: PCT/IB2010/054678
§ 371 (c)(1),
(2), (4) Date: Aug. 3, 2012

(87) PCT Pub. No.: WO2011/045770
PCT Pub. Date: Apr. 21, 2011

(65) Prior Publication Data

US 2012/0294664 A1 Nov. 22, 2012

Related U.S. Application Data

(60) Provisional application No. 61/258,792, filed on Nov. 6, 2009.

(30) Foreign Application Priority Data

Oct. 15, 2009 (FR) ..... 09 57226

(51) Int. Cl.
*A46B 9/02* (2006.01)
*A46D 1/00* (2006.01)
*A45D 40/26* (2006.01)

(52) U.S. Cl.
CPC ..... *A46B 9/021* (2013.01); *A46D 1/00* (2013.01); *A46D 1/0207* (2013.01);
(Continued)

(58) Field of Classification Search
CPC ..... A46B 1/00; A46B 3/005; A46B 9/021; A46B 9/005; A46B 9/026; A46B 2200/1053; A46B 2200/106
(Continued)

(56) References Cited

U.S. PATENT DOCUMENTS 6,328,495 B1 12/2001 Gueret
6,375,374 B2 4/2002 Gueret
(Continued)

FOREIGN PATENT DOCUMENTS

CH 572719 1/1974
CH 572719 A5 1/1974
(Continued)

OTHER PUBLICATIONS

Summary of JPO Office Action dated Nov. 10, 2014 for JP2012-533734.
International Search Report dated Nov. 23, 2010.

*Primary Examiner* — Jennifer C Chiang
*Assistant Examiner* — Bradley Oliver
(74) *Attorney, Agent, or Firm* — Pearne & Gordon LLP

(57) ABSTRACT

A device (2) is provided for applying a composition (P) to the eyelashes and/or the eyebrows. The device includes a molded applicator member (8) including a core (10) having a longitudinal axis (X) and rows of teeth that are carried by the core (10), preferably at least five rows, two teeth belonging to two consecutive rows not being parallel. The outside surface of at least one segment of the core (10) includes only one toothless portion, or only two toothless portions that are situated substantially opposite each other, or each toothless portion being of angular extent lying in the range 75° to 110° around the longitudinal axis.

16 Claims, 8 Drawing Sheets

(52) U.S. Cl.
CPC ..... *A46D 1/0269* (2013.01); *A45D 40/265* (2013.01); *A46B 2200/1053* (2013.01)

(58) Field of Classification Search
USPC ..... 401/118, 129, 268; 15/207.2; 132/218
See application file for complete search history.

(56) References Cited

U.S. PATENT DOCUMENTS

| | | | | |
|---|---|---|---|---|
| 2004/0221865 | A1* | 11/2004 | Kim | 132/218 |
| 2004/0258453 | A1 | 12/2004 | Gueret | |
| 2005/0028834 | A1 | 2/2005 | Ramet | |
| 2005/0046087 | A1* | 3/2005 | De Laforcade | 264/478 |
| 2005/0175394 | A1 | 8/2005 | Gueret | |
| 2007/0033459 | A1 | 2/2007 | Bunce et al. | |
| 2008/0023020 | A1* | 1/2008 | Gueret | 132/218 |
| 2008/0083421 | A1* | 4/2008 | Malvar | A46B 9/021 132/218 |
| 2008/0115798 | A1* | 5/2008 | Rainey | A46B 9/021 132/218 |
| 2010/0300475 | A1* | 12/2010 | Gueret | A46B 9/021 132/218 |
| 2010/0303533 | A1* | 12/2010 | Gueret | A46B 9/021 132/218 |
| 2010/0310295 | A1* | 12/2010 | Gueret | A46B 9/021 132/218 |
| 2010/0310296 | A1* | 12/2010 | Gueret | A46B 9/021 132/218 |
| 2011/0168204 | A1* | 7/2011 | Gueret | A46B 9/021 132/218 |
| 2012/0006349 | A1* | 1/2012 | Iwao | A46B 9/021 132/218 |

FOREIGN PATENT DOCUMENTS

| | | | |
|---|---|---|---|
| DE | 2559273 | | 7/1977 |
| DE | 2559273 | A1 | 7/1977 |
| EP | 1475013 | A1 | 11/2004 |
| EP | 1607020 | | 12/2005 |
| EP | 1607020 | A1 | 12/2005 |
| EP | 1611817 | | 1/2006 |
| EP | 1611817 | A1 | 1/2006 |
| EP | 1872682 | | 1/2008 |
| EP | 1872682 | A1 | 1/2008 |
| EP | 1949815 | A1 | 7/2008 |
| GB | 2071558 | A | 2/1980 |
| GB | 2071558 | A | 9/1981 |
| GB | 2170996 | A | 8/1986 |
| JP | 2006068543 | A | 3/2006 |
| JP | 2008136495 | A | 6/2008 |
| WO | WO2006090343 | | 8/2006 |
| WO | 2007/007449 | A1 | 1/2007 |
| WO | 2007/146212 | A1 | 12/2007 |
| WO | 2009/053922 | A2 | 4/2009 |
| WO | WO2009153753 | | 12/2009 |

* cited by examiner

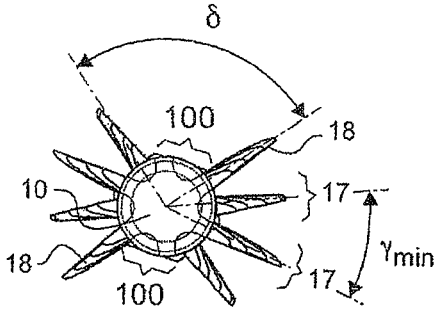
Fig.4a
Fig.4b
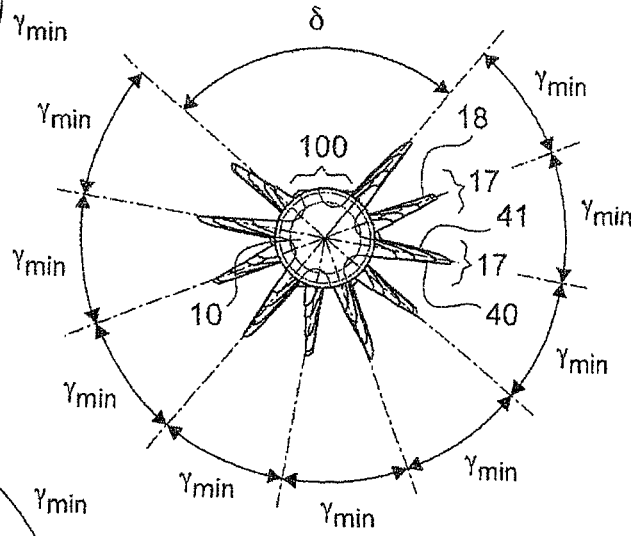
Fig.4c
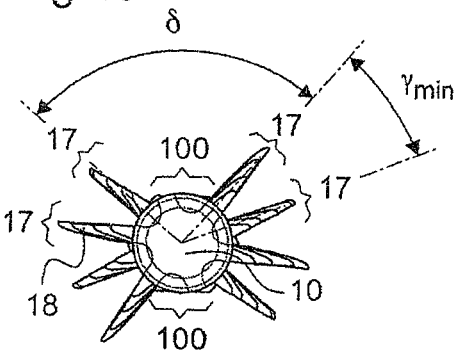
Fig.4d
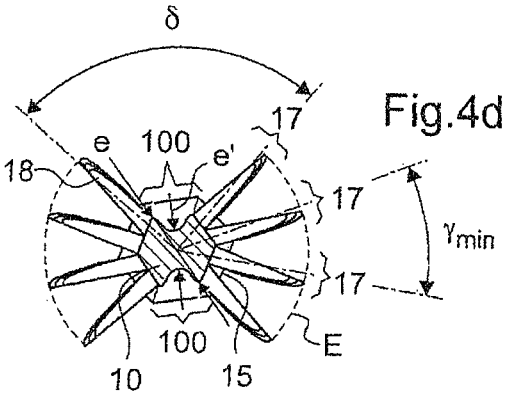
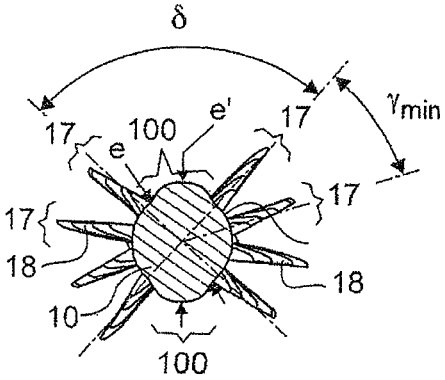
Fig.4e
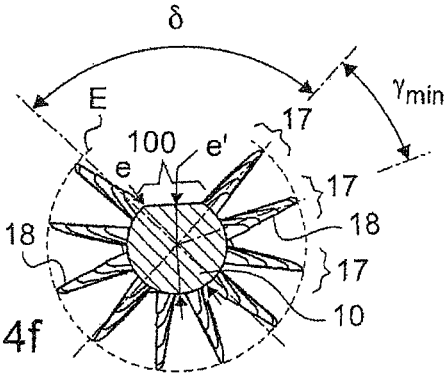
Fig.4f

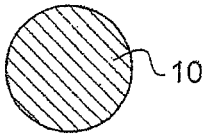
Fig.9
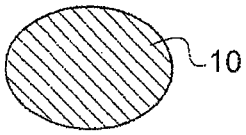
Fig.9a
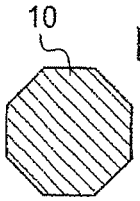
Fig.9b
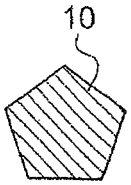
Fig.9c
Fig.9d
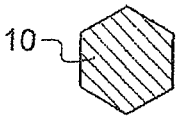
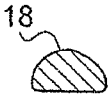
Fig.10
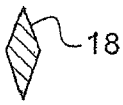
Fig.10a
Fig.10b
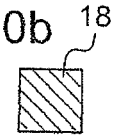
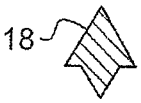
Fig.10c
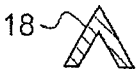
Fig.10d
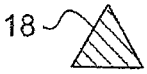
Fig.10e
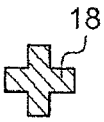
Fig.10f
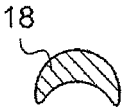
Fig.10g
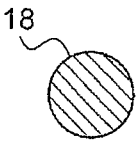
Fig.10h
Fig.10i
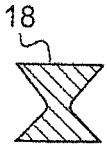
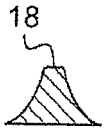
Fig.10j Fig.11
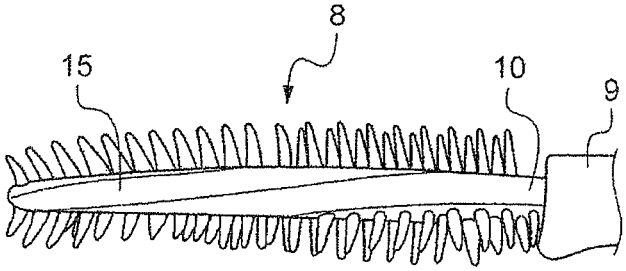
Fig.12
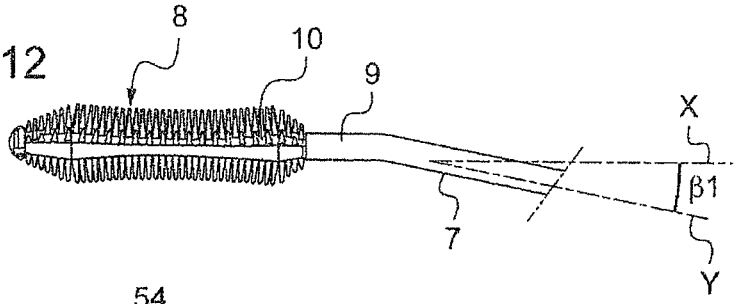
Fig.13
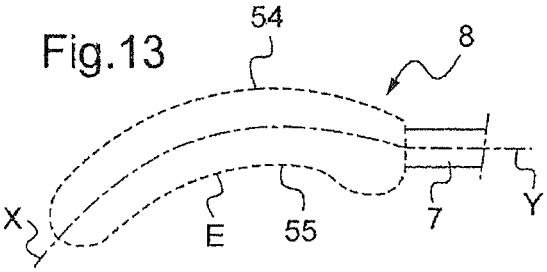
Fig.13a
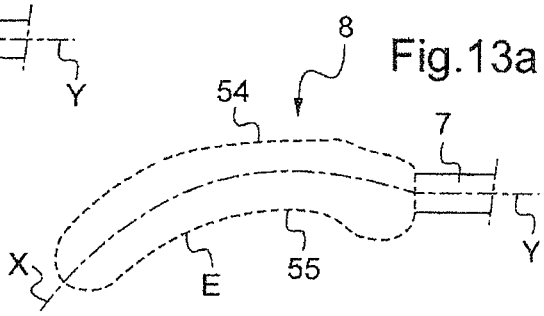
Fig.13b
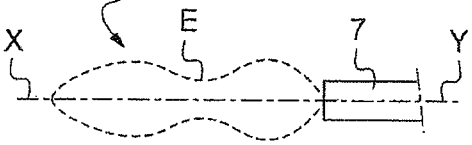
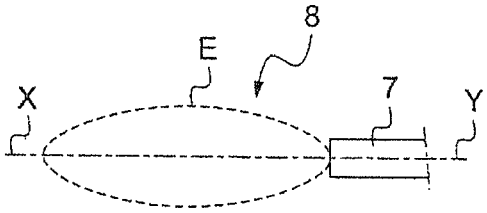
Fig.13c
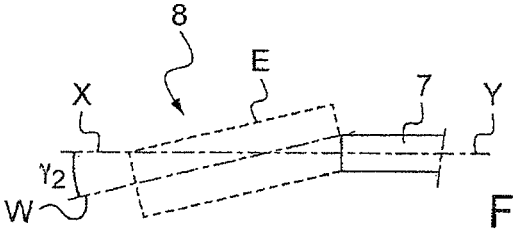
Fig.13d

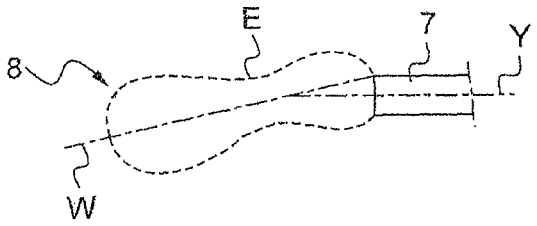
Fig.13e
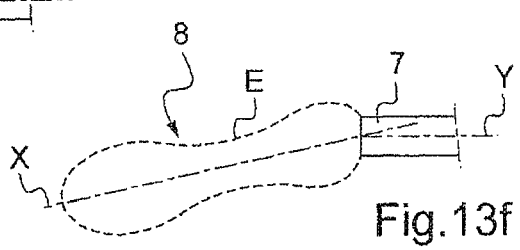
Fig.13f
Fig.14
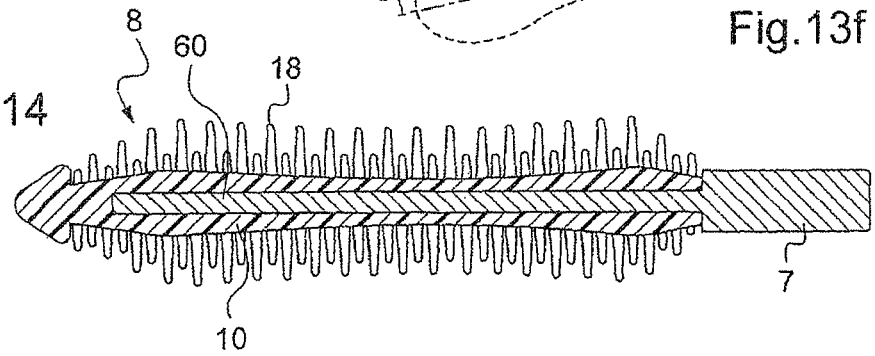
Fig.15
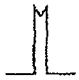
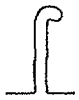
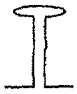
Fig.15b
Fig.15a
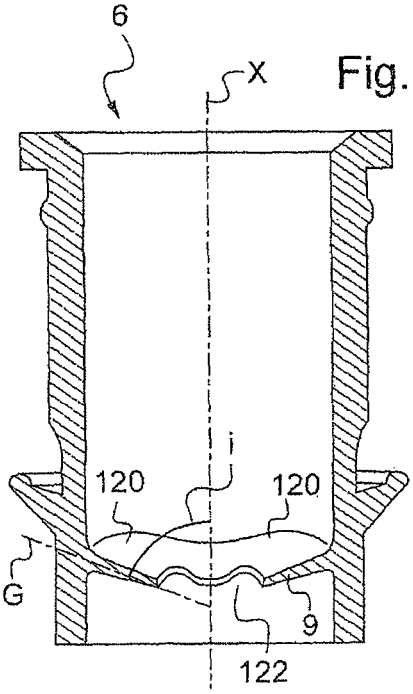
Fig.16
Fig.17
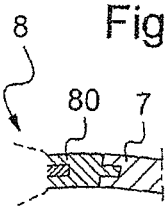
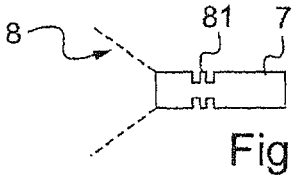
Fig.17a

DEVICE FOR APPLYING A COMPOSITION TO THE EYELASHES OR THE EYEBROWS

The present invention relates to a device for applying a composition to the eyelashes and/or the eyebrows, in particular a makeup or care-product composition, e.g. mascara.

BACKGROUND

Publication GB 2 170 996 discloses twisted-core brushes having bristles that may extend over only substantially 180° around the core.

EP 1 611 817, US 2007/0033459, WO 2007/007449, DE 25 59 273, GB 2 071 558, and EP 1 872 682 disclose applicators for applying mascara to the eyelashes and each including a molded applicator member comprising a core and teeth.

EP 1 475 013 discloses a mascara brush comprising an applicator brush part coupled to an arrangement brush part, said applicator brush part being inserted into a recess present inside the fixing stand supporting the arrangement brush part. Such devices comprise teeth all around their longitudinal axis.

EP 1 949 815, WO 2007/146212, EP 1 607 020 and WO 2009/053922 disclose mascara applicators.

There exists a need to benefit from an applicator that makes it possible to produce novel makeup effects on the eyelashes or the eyebrows that are optionally pre-coated with composition, to obtain good penetration of the applicator member in the eyelashes or the eyebrows, e.g. so as to comb them, load them, extend them, and separate them better, and to do so while enabling a satisfactory quantity of composition to be loaded onto the applicator, and requiring hand movements in use that are easy to perform.

Applicator Device

Exemplary embodiments of the invention provide a device for applying a composition to the eyelashes and/or the eyebrows, the device including a molded applicator member comprising:

a core having a longitudinal axis; and rows of teeth that are carried by the core, preferably at least five rows, two teeth belonging to two consecutive rows not being parallel, the outside surface of at least one segment of the core including only one toothless portion, or only two toothless portions that are situated substantially opposite each other, the or each toothless portion being of angular extent lying in the range 75° to 110° around said longitudinal axis. This angular extent may be greater than the minimum angular offset defined by the rows that are the closest together around the longitudinal axis.

The toothless portion(s) enable(s) the teeth defining the portion(s) to penetrate well into the eyelashes so as to comb them, load them, extend them, and/or separate them.

Furthermore, the presence of the toothless portion(s) makes it possible to improve the load of composition after the device has passed through a wiper.

The term "longitudinal axis of the core" is used to designate the line that joins together the centers of gravity (barycenters) of the cross-sections of the core. The longitudinal axis may be a central axis, or even an axis of symmetry for the core, in particular when the core presents a cross-section that is circular or that has the general shape of a regular polygon. The longitudinal axis of the core may be rectilinear or curved, and may be contained in a plane that may be a plane of symmetry for some or even all of the cross-sections of the core.

The term "tooth" is used to designate an element that projects individually for coming into engagement with the eyelashes, the term being synonymous with "bristle" in the context of the present invention.

In the meaning of the invention, teeth belong to the same "row of teeth" if, when the applicator member is observed along its longitudinal axis, the teeth have a common join plane and/or are superposed other than at their bases, being more than merely tangential to the axis of the row at their bases. It is possible for the bases of the teeth of a single row to be touching or spaced apart. When the teeth are spaced apart, and when the applicator member is observed perpendicularly to the longitudinal axis, the spacing between two consecutive teeth of a single row is measured between the closest-together ends of the bases of said consecutive teeth, and may lie in the range 0.1 millimeters (mm) to 5 mm, for example.

Depending on the example, the core may carry an even or an odd number of rows, e.g. at least five, at least six, at least seven, at least eight, at least nine, or at least ten rows of teeth.

When the longitudinal axis of the core is rectilinear, the angular extent of a toothless portion corresponds to the minimum angle, measured in a cross-section plane perpendicular to the longitudinal axis of the core and around said longitudinal axis, between, on the one hand, a projected center, on said cross-section plane, of a tooth of a first row and, on the other hand, a projected center, on said cross-section plane, of a tooth a second row, said first and second rows defining said toothless portion. In other words, when the longitudinal axis of the core is rectilinear, the angular extent of a toothless portion is equal to the minimum angular extent dividing the projected centers, on a cross-section plane perpendicular to said longitudinal axis of the core, of the teeth of the two rows defining said toothless portion, said minimum angular extent being measured around said longitudinal axis and in said cross-section plane.

When the longitudinal axis of the core is curved, the angular extent of a toothless portion corresponds to the angular extent of a toothless portion of an applicator member image of the applicator member having a curved longitudinal axis by the mathematical transformation transforming the applicator member having a curved longitudinal axis in an applicator member having a rectilinear longitudinal axis tangential to the curved longitudinal axis at the proximal end of the applicator member. The rectilinear longitudinal axis may be in most embodiments aligned with the longitudinal axis of the stem carrying the applicator member.

In the meaning of the present invention, the term "angular offset defined by two rows" is used to designate the minimum angle, around the longitudinal axis, between the centers of the bases of the teeth of the two rows under consideration. The angular offset defined by two rows is measured as described above for the angular extent of the toothless portion(s). In the meaning of the invention, the "closest-together rows" are the two rows that present a minimum angular offset as defined above.

The term "segment of the core" is used to designate a fraction of the portion of the core carrying teeth, which fraction lies between first and second abscissas, measured along the longitudinal axis of the core.

The term "two points of the circumference of the core that are situated opposite each other" should be understood to mean that, when the applicator member is observed in cross-section, the two points correspond to each other in central symmetry with respect to the center of symmetry of the cross-section of the core as a center of symmetry, if one exists, and if not, the two points and the center of gravity of the cross-section of the core are in alignment. For example, for a core of circularly-cylindrical shape, two diametrally-opposite points of a single cross-section of the core are situated opposite each other.

The term "two portions of the outside surface of the core that are situated substantially opposite each other" should be understood to mean that, when the applicator member is observed in cross-section, at least 75%, e.g. at least 90%, or even all of the points constituting a first one of the portions are situated opposite points that constitute the other portion.

The term "two rows of teeth that are situated substantially opposite each other" is used to mean two rows that are connected to respective portions of the outside surface of the core, that are substantially opposite each other.

The term "length of a tooth" is used to designate the distance measured along the long axis of the tooth between the free end of the tooth and its base via which it is connected to the core. The term "long axis of the tooth" is used to mean an axis that passes via the centers of gravity of the cross-sections of the tooth.

At least two rows of teeth that are consecutive around the longitudinal axis of the core may have longest teeth of length(s) that are identical or different, for example.

The device of the invention may include at least two rows of teeth situated substantially opposite each other, having longest teeth that are substantially of the same length, e.g. having the same length to within 10%.

The term "parallel teeth" is used to designate teeth having long axes that are parallel to each other.

The (combined) length of the segment(s) on which the toothless portion or the substantially-opposite toothless portions of the outside surface of the core is/are present, may be greater than or equal to 50% of the length of the portion of the core carrying the teeth, e.g. greater than or equal to 75%, or equal to 100%. Thus, when observed along the longitudinal axis of the core, it is possible that the applicator member does not present teeth on one or two portions of its outside surface.

When the applicator member includes a toothless portion, the toothless portion may occupy in the range 7% to 40%, e.g. 10% to 30%, e.g. 15% to 30%, of the outside surface of the corresponding segment of the core.

When the applicator member includes two substantially-opposite toothless portions, each of the toothless portions may occupy in the range 7% to 40%, e.g. 10% to 30%, e.g. 15% to 30%, of the outside surface of the corresponding segment of the core.

Around the longitudinal axis of the core, the angular extent of the toothless portion or of each of the substantially-opposite toothless portions may lie in the range 75° to 110°, e.g. in the range 85° to 100°, e.g. in the range 90° to 100°.

The angular extent of the toothless portion or of each of the substantially-opposite toothless portions may be a multiple that is at least twice the minimum angular offset, in particular at least three times said offset. The minimum angular offset may be less than 60°, in particular less than 45°, or even less than 40°, said minimum offset possibly being substantially equal to 30°.

The term "tooth extending from the core in substantially radial manner" is used to designate a tooth having a long axis that forms an angle of less than 15° relative to a radius of a cross-section of the core, said radius containing the center of the base of said tooth.

Regardless of the embodiments under consideration, at least 50% of the teeth, e.g. of each of the rows of the applicator member, e.g. at least 75%, e.g. substantially all of the teeth, may extend from the core in substantially radial manner.

Regardless of the embodiments under consideration, at least two consecutive rows may have longest teeth of different lengths.

In a variant, the applicator member may present two opposite toothless portions, and rows of teeth that extend in optionally radial manner, at least two consecutive rows having longest teeth of identical length. In a variant, the applicator member may present two opposite toothless portions, and rows of teeth that extend in optionally radial manner, at least two consecutive rows having longest teeth of different lengths. When two consecutive rows have longest teeth of different lengths, at least one of said consecutive rows may be adjacent to the toothless portion(s).

When the applicator member is observed perpendicularly to the longitudinal axis, the toothless portion or at least one of the two substantially-opposite toothless portions may be plane, concave, or convex.

The applicator member of the invention may include teeth having free ends that are at equal distances from the center of symmetry of the cross-section of the core, or, if no center of symmetry, from its center of gravity, over at least one segment of the core of length that is greater than or equal to 50%, 75%, or 100% of the length of the portion of the core carrying the teeth.

In exemplary embodiments of the invention, the applicator member is molded within a mold that is formed by assembling together a plurality of shells of which at least two consecutive shells having facing faces without cavities for forming teeth.

For example, four shells might have facing faces without cavities for forming teeth.

The mold may include sets of shells that lead to forming at least two groups of teeth that are situated opposite one another. For example, two groups of shells, situated substantially opposite each other, may each comprise at least two consecutive shells that have facing faces without cavities for forming teeth.

By way of example, the applicator member may be molded by assembling together ten or twelve shells, the number of shells being selected as a function of the number of rows to be made.

All the teeth of the applicator member may be molded with a monolithic core, and said teeth may be made out of a single or a plurality of different materials.

In various disclosed embodiments, the applicator member may be molded with the stem.

Core, Stem, and Endpiece

The core may have a cross-section of shape that is optionally constant along the longitudinal axis of the core, e.g. over at least half, or three-fourths, or even all of the length of the portion of the core carrying the teeth. By way of example, the section may vary in geometrically-similar manner.

On going from the proximal end to the distal end of the applicator member, the cross-section of the core may increase or decrease in monotonic manner, for example.

On going from the proximal end to the distal end of the applicator member, the cross-section of the core may present an extremum, e.g. an absolute minimum or maximum.

The core may present a cross-section that is not circular over the major fraction of its length. The core may optionally be of generally circularly-symmetrical shape. It need not be circularly cylindrical, and it may have no portions in relief other than the teeth. Over at least a fraction of its length, the core may present a cross-section of shape selected from the following list: circular or non-circular; semi-circular; elliptical; oblong; semi-elliptical; polygonal; square; hexagonal; octagonal; and semi-polygonal. The shape may vary along the longitudinal axis of the core.

The core may be of cross-section that is polygonal, e.g. hexagonal or square, and may present only one face that is toothless, or only two opposite longitudinal faces that are toothless, over all or part of their length.

For example, when the cross-section of the core is polygonal, in particular hexagonal, it may have only two opposite longitudinal faces that are toothless over all or part of their length, whereas each of the other faces presents at least one row of teeth, e.g. two rows of teeth.

In exemplary embodiments, the core has a cross-section that is polygonal, in particular hexagonal, with only two opposite faces that do not have teeth over all or part of their length, whereas each of the other longitudinal faces that correspond to the other sides of the polygon presents two rows of teeth over all or part of its length.

It is possible that the toothless face or at least one of the two toothless faces are not plane over at least a fraction or their length, e.g. being concave or convex when the applicator member is observed perpendicularly to the longitudinal axis of the core.

In a variant, the core may include at least one plane longitudinal face without teeth.

When the longitudinal axis of the core is curved, it is possible, for example, that the two opposite toothless portions are present respectively on the concave side and on the convex side of the longitudinal axis of the core, or respectively entirely on either side of a mid-plane of the core, which mid-plane contains the longitudinal axis of the core.

In particular when the applicator member has a core of cross-section that is polygonal, e.g. hexagonal, the width of the toothless face, or of the two toothless faces, may vary, and, by way of example, may present one or two maximums along the longitudinal axis of the core.

When observed perpendicularly to its longitudinal axis, the core may present a profile that varies. In particular, the core may present a transverse dimension that reaches an extremum substantially mid-way along its length. This may impart increased flexibility or rigidity to the core, and makes it possible to define an envelope surface of section that varies along the applicator member, in particular when the teeth in a row are of the same length, at least over a fraction of the applicator member.

The core may include at least one twisted longitudinal face that is optionally toothless. The applicator member may present a helical distribution of the teeth on the core, oriented clockwise or counter-clockwise on going towards the distal end of the applicator member.

In at least one cross-section plane, the core may have an axis of symmetry that is its longitudinal axis, for example.

The core may include a recess in which there is engaged a support portion, e.g. made of metal or plastics material. The core may be configured to be fastened to the support, or it may be free to turn or to move in translation relative to the support.

In a variant, the portion of the core that supports the teeth may be solid. The core may include an endpiece or a housing at one of its ends only, so as to enable it to be fastened to a stem connected to a handle.

The core and the teeth may be molded out of a single material, or, in a variant, they may be made out of at least two different materials. By way of example, a portion of the core and of the teeth may be made out of a first material, and another portion of the core and of the teeth may be made out of a second material, e.g. that is more flexible or harder than the first.

By way of example, the core is formed of one or more thermoplastic materials that may be elastomeric.

In exemplary embodiments of the invention, the teeth are made with the core by molding or by overmolding. By way of example, the teeth may be made by protrusion with material being injected through at least a portion of the core, so as to enable teeth to be formed.

The core may include a sleeve carrying the teeth, which sleeve is free to rotate or to move in translation relative to a hub of the core for mounting on the stem or forming part of said stem.

In exemplary embodiments of the invention, the eyelashes may be loaded with composition that is in contact with the core, in particular in contact with the toothless portion(s). The toothless portion(s) may thus participate in active manner in applying composition to the eyelashes, thereby offering more freedom in the choice and the arrangement of the teeth.

The applicator member may be fastened on a stem that is connected to a handle of the applicator, e.g. by snap-fastening, adhesive, heat sealing, crimping, stamping, force-fitting, cold or hot, e.g. by mounting in a housing of the stem. In a variant, the stem may be received in a housing provided in the core.

The stem and the applicator member may also be molded as a single part, optionally out of the same thermoplastic material.

The core may extend along a longitudinal axis that, at at least one point along its length, forms an angle with the longitudinal axis of the stem to which the core is fastened. The applicator member may be bent where it connects to the stem.

The stem may comprise a rigid first portion that is extended at its distal end by a more flexible second portion, e.g. made of elastomer, carrying the applicator member.

The container may include a wiper member that may be adapted to wipe the stem and the applicator member.

The applicator member may include a mounting endpiece that is molded integrally with the core, and that may, where appropriate, include one or more constricted portions making it possible to improve the flexibility of the applicator and flexibility in application.

Envelope Surface

The free ends of teeth of the applicator member define an envelope surface of the applicator member.

When observed along the longitudinal axis of the core, all or part of the envelope surface may have the general shape of a horseshoe or of a bow-tie, depending on whether it lacks teeth over one portion or over two opposite portions.

Where appropriate, the envelope surface may extend along a longitudinal axis that forms a non-zero angle with the longitudinal axis of the core.

The greatest transverse dimension of the envelope surface of the applicator member, measured perpendicularly to the longitudinal axis of the core, may lie in the range 3 mm to 14 mm.

The envelope surface may be of greatest transverse dimension that is substantially constant over at least a fraction of the length of the applicator member, in particular over more than half of the length of the portion of the core carrying teeth.

The envelope surface may also present a cross-section that varies over all or part of the length of the applicator member. By way of example, the cross-section of the envelope surface may have one or more extremums, e.g. at least one local minimum and two maximums. By way of example, the envelope surface may be peanut-shaped when the applicator member is observed from the side, in a direction that is perpendicular to its longitudinal axis.

Teeth and Rows of Teeth

The longest teeth of the applicator member may have a length lying in the range 1 mm to 6 mm, e.g. 1.7 mm to 4.5 mm. More than half of the teeth may have a length as defined above, better at least 60%, or even at least 70%, or even all of the teeth.

The average length of the teeth of the applicator member may, for example, lie in the range 1 mm to 6 mm, e.g. 1.7 mm to 4.5 mm.

The length of the teeth of at least one row may vary within a row, e.g. in monotonic manner, on going along the longitudinal axis of the core. For example, on going along the longitudinal axis of the core, the length of the teeth within at least one row may increase between the proximal end and a first abscissa, then remain substantially constant between the first abscissa and a second abscissa, then decrease between the second abscissa and the distal end. For example, the length of the teeth within at least one row may have two maximums.

From one row to another, the teeth may differ by at least one of their shape, thickness, length, orientation, color, and/or material. In the context of the invention, it is possible that, within a single row, the teeth differ by at least one of their thickness, length, hardness, orientation, spacing with the adjacent teeth of the row, color, and/or shape.

Over at least one segment of the core that possibly extends over at least 50%, e.g. at least 75%, e.g. 100% of the length of the portion of the core carrying the teeth, the toothless portion(s) may be defined by rows of teeth having a longest tooth of length that is shorter, or, in a variant, longer than the longest tooth of the row consecutive thereto.

Some of the teeth, or even all of the teeth, may have a cross-section of shape that is semi-circular or semi-elliptical. A shape with a flat, such as a semi-circular or semi-elliptical shape, makes it easier to unmold the applicator member, the flat coinciding with the join plane of the mold.

At least one tooth may present a cross-section that is: circular, with or without a flat; non-circular; flat; star-shaped, e.g. cross-shaped or having a plurality of branches; U-shaped; H-shaped; T-shaped; V-shaped; a hollow shape, e.g. circular or square; formed with ramifications, e.g. snow-flake-shaped; a prismatic shape, e.g. triangular, square, or hexagonal; an oblong shape, in particular lens-shaped or hourglass-shaped; polygonal, optionally regular, in particular square, rectangular, octagonal, parallelogram-shaped, lozenge-shaped; or oval. At least one tooth may present at least one portion in relief, so as to improve the adherence of composition to the tooth. Without changing in shape, the cross-section of the tooth may decrease on going away from the core, e.g. over more than half of the length of the tooth.

Some of the teeth of the applicator, or even all of the teeth, may have thickness, measured at their base, i.e. at the point where a tooth connects to the core, lying in the range 0.2 mm to 0.8 mm, or even in the range 0.3 mm to 0.5 mm. The term "thickness of a tooth" is used to designate the greatest transverse dimension of the tooth, in section that is perpendicular to the long axis of the tooth.

The thickness of the teeth may be selected as a function of the type of makeup effect desired and/or the nature of the eyelashes and/or the rheology of the composition, for example.

The teeth may be of any shape. The teeth may be of shape that is cylindrical or tapering, in particular frustoconical or pyramid-shaped. At least one tooth may have a profile that is frustoconical, at least in part, e.g. terminated by a rounded free end, such that the cross-section of the tooth decreases towards its free end.

The applicator may include between 75 and 500 teeth, for example. Within a row of teeth, the number of teeth may lie in the range 6 to 60, in particular in the range 10 to 50.

At least two teeth of at least one row may present lengths that are different or identical. A row of teeth extending along the longitudinal axis may have at least three teeth of the same length.

When the applicator is observed from the side, perpendicularly to its longitudinal axis, at least two teeth may define a V-shaped groove.

At least two consecutive teeth of a row of teeth may have first longitudinal faces both having a common first shape, e.g. plane, in particular at least at a bottom portion of the tooth, and second longitudinal faces both having a common second shape, e.g. not plane, in particular rounded. In exemplary embodiments, the first faces may all face in the same direction around the core, i.e. they may all face in the same clockwise or counter-clockwise direction, when the core is observed along its longitudinal axis.

The first faces of the teeth, in particular when they are plane, may be connected substantially perpendicularly to the corresponding face of the core, at least for some teeth in the row.

At least one tooth, or even each tooth, may present a plane face that is parallel to its long direction.

The teeth may optionally be rectilinear, e.g. each extending along a long direction for the tooth that is rectilinear, or else they may be curved, e.g. undulating.

Since the longitudinal axis of a row is considered at the surface of the core, two longitudinal axes of two consecutive rows, around the longitudinal axis of the core, may be separated angularly by an angle that is less than 80°, e.g. about 60°, or even less than 50°, e.g. about 45°, e.g. about 30°. The axes of the rows may be parallel to the longitudinal axis of the core.

The teeth may extend in at least four different directions around the longitudinal axis of the core.

At least one tooth of a row may extend, at least at its portion that is connected to the core, or even over its entire length, along a first direction $Z_1$, perpendicular to the longitudinal face of the core to which the tooth is connected, or forming a small angle with the normal to said surface of the core, e.g. less than 10°, better 5°. A tooth of a consecutive row may extend from the same face of the core along a second direction $Z_2$, at least at the portion that is connected to the core, or even over its entire length, forming a non-zero angle $\alpha$ with the first direction, when the core is observed along its longitudinal axis.

Substantially half of the teeth of a row may extend parallel to the first direction $Z_1$. The angle $\alpha$ between the directions $Z_1$ and $Z_2$ may lie in the range 5° to 80°.

The length of a row may lie in the range about 10 mm to 45 mm, in particular in the range 15 mm to 35 mm, or even in the range 20 mm to 30 mm, e.g. being about 25 mm.

When the core is observed along its longitudinal axis, it is possible to pass from one row to another by turning the core about its longitudinal axis through an integer sub-multiple of 360°, e.g. turning through 360°/n, where n is an integer that lies in the range 3 to 20, for example.

The teeth may be made of a material that is more rigid or less rigid than a material that is used to make the stem of the applicator to which the core is connected.

Packaging Device and Method

The invention also provides a packaging and applicator device for applying a composition to keratinous fibers, in particular the eyelashes or the eyebrows, the device comprising an applicator as defined above, and a container containing the composition. The handle of the applicator may constitute a closure cap for closing the container. The container may include a wiper member. The composition may be a mascara, e.g. a water-resistant mascara.

The invention also provides a method of applying makeup to the eyelashes or the eyebrows by means of an applicator as defined above.

In other exemplary embodiments the present invention relates to a method of manufacturing a device as defined above, the method comprising at least a step of molding the core and the teeth in a mold that is formed by assembling together shells, e.g. ten or twelve shells, with at least two, or even three consecutive shells having facing faces without cavities for forming teeth.

For example, in the method of manufacture of the invention, four shells might have facing faces without cavities for forming teeth.

For example, at least two groups of shells, situated substantially opposite each other, may each comprise at least two consecutive shells that have facing faces without cavities for forming teeth.

DESCRIPTION OF THE DRAWINGS

The invention can be better understood on reading the following detailed description of non-limiting embodiments thereof, and on examining the accompanying drawings, in which:

FIGS. 4*a* to 4*h* show variant embodiments;

FIGS. 9 and 9*a* to 9*d* show various shapes of core section;

FIGS. 10 and 10*a* to 10*j* show various shapes of tooth section;

FIGS. 11 and 12 are diagrammatic side views showing a variant applicator member of the invention;

FIGS. 13 and 13*a* to 13*f* show longitudinal sections of variants;

FIG. 14 is a longitudinal section of a variant applicator member of the invention;

FIGS. 15, 15*a*, and 15*b* are diagrams of examples of teeth of the invention;

FIG. 16 shows an example of a wiper member; and

FIGS. 17 and 17*a* show examples of configurations that make it possible to increase the flexibility of the applicator member.

FIG. 1 shows a packaging and applicator device 1 made in accordance with the invention, the device comprising an applicator 2 and an associated container 3 containing a composition P for application to the eyelashes and/or the eyebrows, e.g. mascara or a care product.

Figure 1:
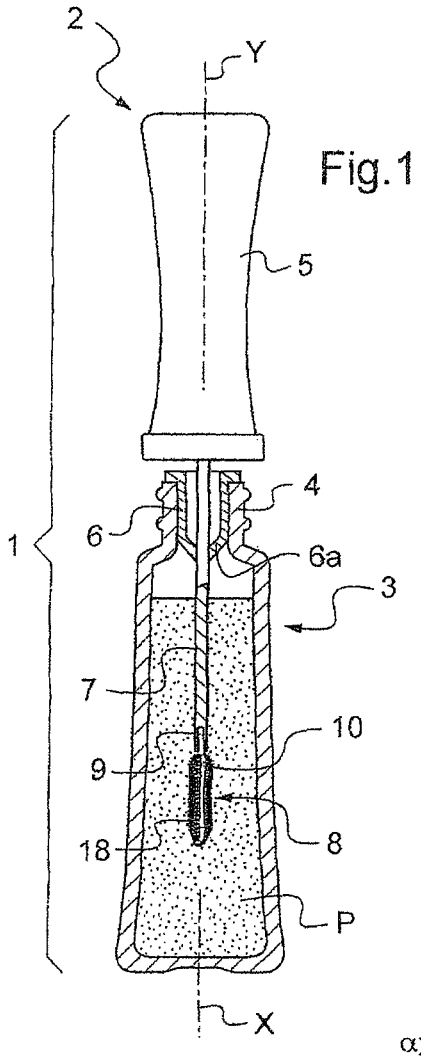
FIG. 1 is a diagrammatic and fragmentary longitudinal section view in elevation showing an example of a device made in accordance with the invention.

In the embodiment under consideration, the container 3 includes a threaded neck 4, and the applicator 2 includes a closure cap 5 that is arranged to be fastened on the neck 4 so as to close the container 3 in leaktight manner when not in use, the closure cap 5 also constituting a handle for the applicator 2.

The applicator 2 includes a stem 7 of longitudinal axis Y, which stem is connected at its top end to the closure cap 5, and at its bottom end to an applicator member 8. The applicator member comprises a core 10 carrying teeth 18.

The container 3 also includes a wiper member 6 that is inserted in the neck 4, for example.

In the embodiment under consideration, the wiper member 6, that may be of any type, includes a lip 6*a* that is arranged to wipe the stem 7 and the applicator member 8 while the applicator 2 is being removed from the container 3. The lip 6*a* defines a wiper orifice of diameter that is adapted to the diameter of the stem.

In the embodiment shown, the stem 7 presents a cross-section that is circular, but it would not be beyond the ambit of the present invention for the stem 7 to present some other section, the cap 5 thus possibly being fastened on the container 3 other than by screw-fastening, if necessary. The wiper member 6 could be adapted to the shape of the stem 7 and to the shape of the applicator member 8, where appropriate.

In the embodiment under consideration, the longitudinal axis Y of the stem 7 is rectilinear and coincides with the longitudinal axis of the container 3 when the applicator 2 is in place thereon, but it would not be beyond the ambit of the present invention for the stem 7 to be non-rectilinear, e.g. forming a bend.

Where appropriate, the stem 7 may include an annular narrowing at its portion that comes to be positioned facing the lip 6*a* of the wiper member 6, so that said wiper member is not mechanically stressed unduly during storage.

As shown, the applicator member 8 may include an endpiece 9 enabling it to be fastened in the stem 7. In the embodiment in FIGS. 1 and 2, the endpiece 9 is circularly symmetrical, being of circular cross-section, but it could be of some other shape.

In particular, the applicator member 8 may be fastened by force-fitting, in particular snap-fastening, by adhesive, by heat-sealing, or by crimping in a corresponding housing provided at the end of the stem 7. In a variant, the stem may be inserted into a housing provided in the core. The core 10 may also be molded integrally with the stem 7.

Figure 3:
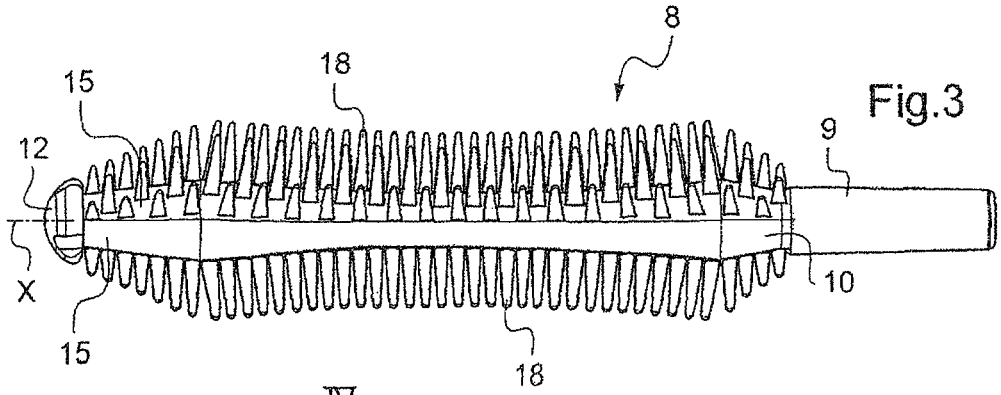
FIGS. 3 and 3*a* are views from two different view points of the applicator member of the FIG. 1 device, shown in isolation.

With reference to FIG. 3, it can be seen that the core 10 may be of elongate shape that extends along a longitudinal axis X.

In the embodiment under consideration, over the majority of its length, the core 10 may present a cross-section that is polygonal, having sides that define longitudinal faces 15. By way of example, the longitudinal axis is central, as shown.

In the embodiment under consideration, the teeth 18 are made integrally with the core 10 by molding thermoplastic material.

In order to mold the applicator member 8, it is possible to use a thermoplastic material that is optionally relatively rigid, e.g. styrene-ethylene-butylene-styrene (SEBS); a silicone rubber; latex rubber; butyl rubber; ethylene-propylene-terpolymer rubber (EPDM); a nitrile rubber; a thermoplastic elastomer; a polyester, polyamide, polyethylene, or vinyl elastomer; a polyolefin such as polyethylene (PE) or polypropylene (PP); polyvinyl chloride (PVC); ethyl vinyl acetate (EVA); polystyrene (PS); polyethylene terephthalate (PET); polyoxymethylene (POM); polyamide (PA); or polymethyl methacrylate (PMMA). In particular, it is possible to use materials known under the trade names Hytre®, Cariflex®, Alixine®, Santoprene®, Pebax®, this list not being limiting.

Figure 3A:
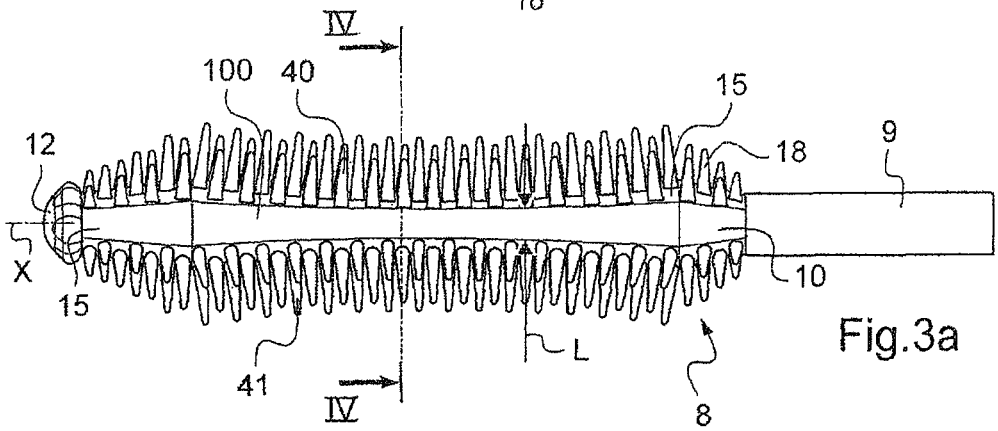

FIG. 3*a* is a side view of the FIG. 3 applicator member 8 after it has been turned about the longitudinal axis of the core 10.

The teeth and the core may be made out of different materials, where appropriate.

In variants, the applicator member 8 presents one or two portions of the core 10 that are not provided with teeth 18, as described below.

Figure 4:
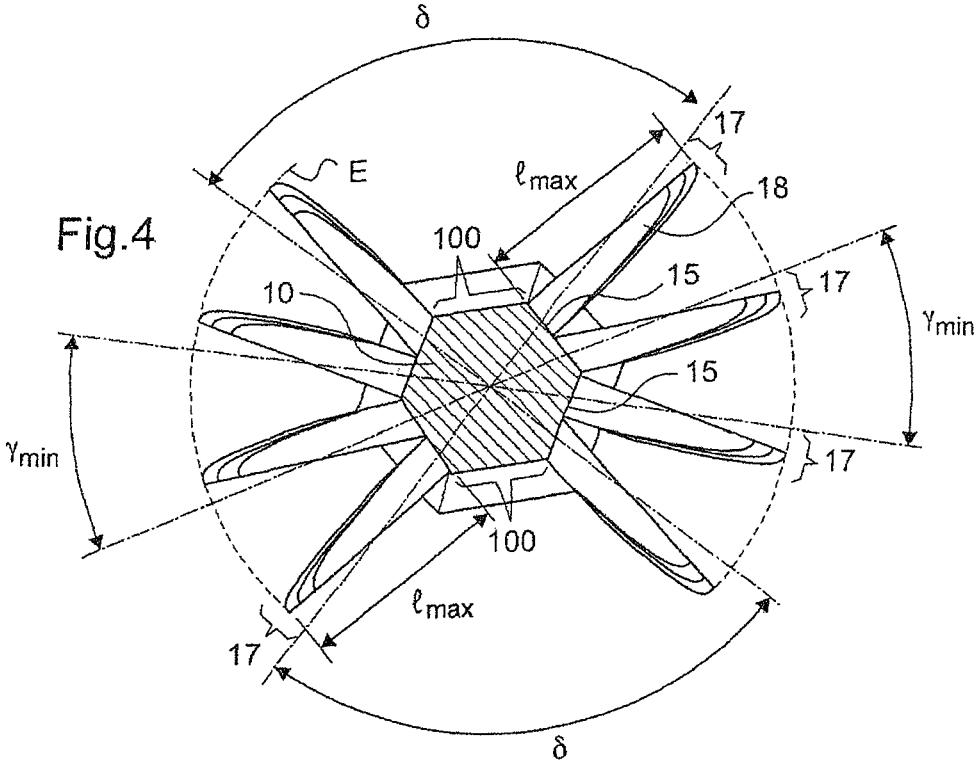
FIG. 4 is a section on IV-IV of FIG. 3*a;*

In FIGS. 4 and 4*a* it can be seen that the applicator member presents two opposite faces 100 that are not provided with teeth, whereas each of the other faces 15 includes at least one row 17 of teeth, in this example two. The width L of each face 15 or 100 may vary along the longitudinal axis of the core X, as shown in FIG. 3*a*.

In the embodiment in FIGS. 3, 3*a*, 4, and 4*a*, the core 10 presents a cross-section that is hexagonal.

The length of the teeth 18 may decrease towards the distal end 12 of the core 10, as can be seen in FIGS. 3 and 3*a*.

The length of the teeth 18 may also decrease towards the endpiece 9, as shown in FIGS. 3 and 3*a*, so as to make it easier for the applicator member 8 to pass through the wiper member 6 while the applicator 2 is being removed from the container.

In addition, as can be seen in FIG. 3*a* in particular, each tooth 18 may include a first longitudinal face 40 of plane shape and a second longitudinal face 41 of rounded shape, in particular of half-cone shape.

It can be seen in FIG. 4 that the rows of teeth 18 that are the closest together, define between them a minimum angular offset $\gamma_{min}$, and that the two substantially-opposite toothless portions 100 are of angular extent 6 that is greater than $\gamma_{min}$. $\delta$ may be a multiple of $\gamma_{min}$, and, as shown, it may be substantially equal to three times $\gamma_{min}$ for example. It is also possible that $\delta$ is substantially equal to twice $\gamma_{min}$, for example.

It can be seen in FIG. 4 that two opposite rows 17 may both have teeth of the same length $l_{max}$.

FIG. 4*c* shows the possibility of two substantially-opposite toothless portions 100 that are present over the entire length of the core 10, which core has an outside surface of shape that is substantially circularly cylindrical. The applicator member 8 may have eight rows 17 of teeth 18, as shown.

FIG. 4*b* shows the possibility of only one toothless portion 100 that is present over the entire length of the core 10, which core has an outside surface of shape that is substantially circularly cylindrical. The applicator member 8 may have ten rows 17 of teeth 18, as shown.

Figure 4G:
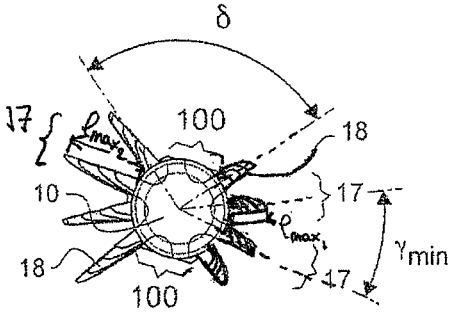

FIG. 4*g* shows the possibility of two substantially-opposite sets of rows 17 of teeth 18, divided by two substantially-opposite toothless portions 100, each of the set of rows 17 having longest teeth of different length, respectively $l_{max1}$ and $l_{max2}$.

Figure 4H:
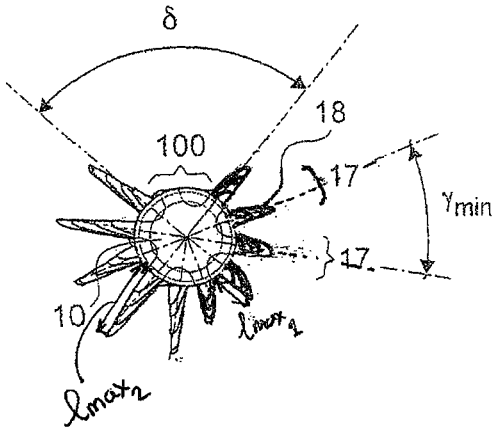

FIG. 4*h* shows the possibility of only one toothless portion 100 with two substantially-opposite sets of rows 17 of teeth 18, each having longest teeth of different length, $l_{max1}$ and $l_{max2}$, respectively.

The core 10 may, for e.g., have an outside surface that is circularly-cylindrical, as shown in particular in FIGS. 4*g* and 4*h*, or may, in a variant not shown, have a polygonal cross-section.

FIGS. 4*d* to 4*f* show embodiments in which the thickness e' of the core 10 at a mid-plane bisecting the toothless portions 100 differs from the thickness e taken elsewhere.

In FIG. 4*d*, the substantially-opposite toothless faces 100 are concave and e' is less than e.

In FIG. 4*e*, the substantially-opposite toothless portions 100 are convex and e' is greater than e.

In FIG. 4*f*, the toothless portion 100 is plane and e' is less than e.

When the applicator member is observed along its longitudinal axis, the envelope surface E may be horseshoe shaped, as shown in FIG. 4*f*, or, in a variant, bow-tie shaped, as shown in FIG. 4*d*.

Figure 5:
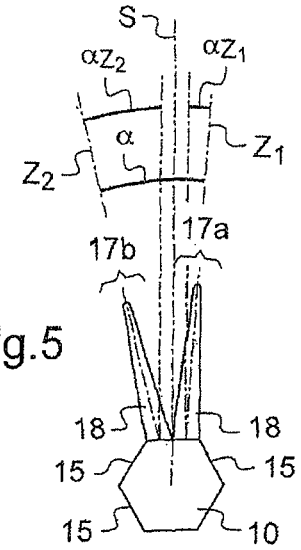
FIG. 5 shows a detail of FIG. 4.

As shown in FIG. 5, each face 15 includes a first row of teeth 17*a* that are connected to the corresponding face 15 of the core 10 while forming an angle $\alpha_{Z1}$ relative to the normal thereto, and a second row of teeth 17*b* that are connected to the face 15 obliquely, forming an angle $\alpha_{Z2}$ relative to said normal. The teeth 18 of the first row 17*a* extend along a direction $Z_1$ that is substantially perpendicular to the face 15, the angle $\alpha_{Z1}$ being relatively small, e.g. less than 10°, or even less than 5°. The teeth 18 of the row 17*b* are also straight in the embodiment under consideration, extending along a direction $Z_2$, forming an angle $\alpha$ with the direction $Z_1$. By way of example, the angle $\alpha$ lies in the range 20° to 80°. The teeth 18 of each row 17*a* and 17*b* may be separated by a separation surface S, the surface S being a plane bisecting the angle $\alpha$, for example.

Figure 6:
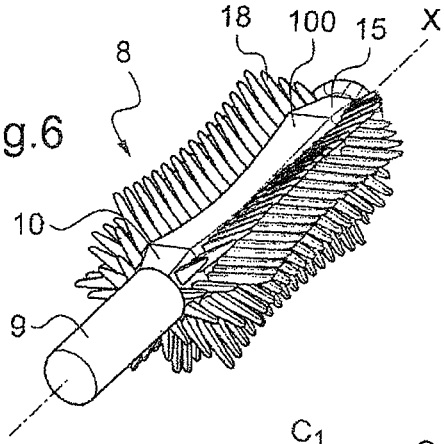
FIGS. 6 and 6*a* are diagrammatic perspective views of other examples of applicator members.

FIG. 6 is a perspective view showing another embodiment of an applicator member of the invention, having a single toothless face 100 that is concave over a fraction of its length, when the applicator member is observed from the side.

Figure 6A:
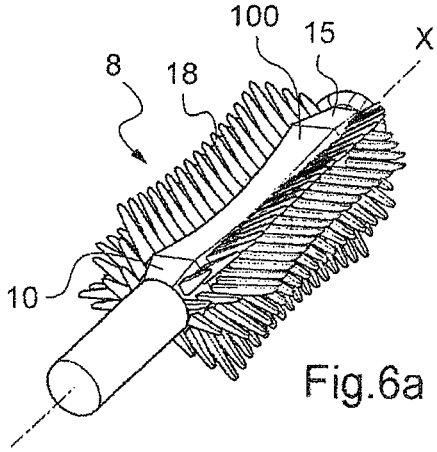

The applicator member in FIG. 6*a* differs from the applicator member in FIG. 6 in that it includes two opposite toothless faces 100.

Figure 7:
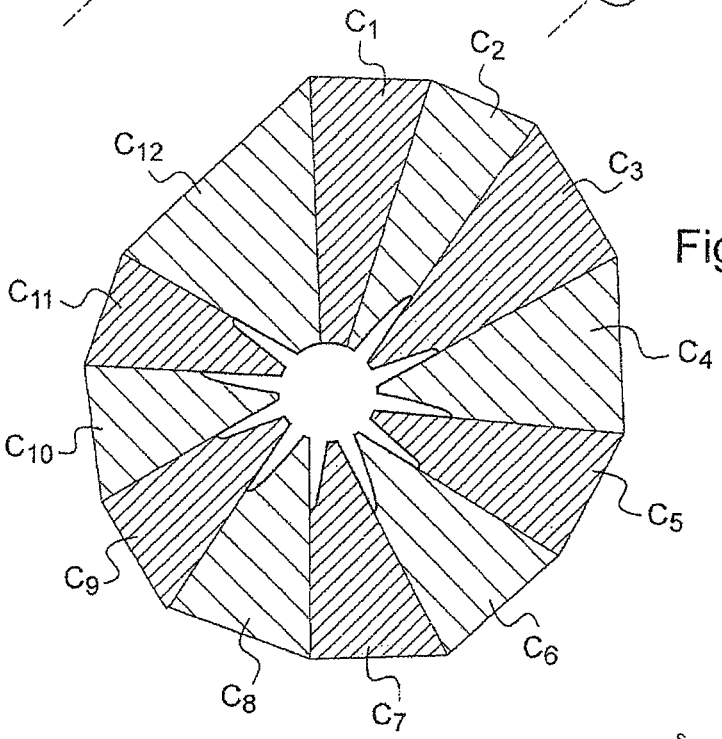
FIG. 7 shows the applicator member being made in a mold.

FIG. 7 shows, in cross-section, a shell mold that is used to make the applicator member. The mold comprises twelve shells $C_1, C_2, \ldots, C_{12}$ having consecutive shells $C_1$ and $C_{12}$ with facing faces that do not have cavities for forming teeth, thus molding no teeth, whereas each of the shells $C_2$ to $C_{11}$ includes cavities that make it possible to mold a row of teeth.

The number of shells and the number of cavities per shell may vary. For example, ten shells may be used without going beyond the ambit of the present invention. It is also possible that each of at least two consecutive shells has cavities for forming half-teeth on their facing faces, two consecutive shells thus being necessary in order to form one tooth.

It is also possible that two groups of shells, situated substantially opposite each other, may each comprise at least two consecutive shells having facing faces without cavities for forming teeth.

Figure 8:
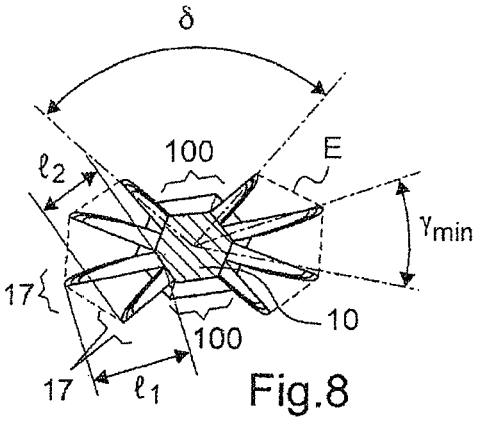
FIGS. 8 and 8*a* show variant embodiments.
Figure 8A:
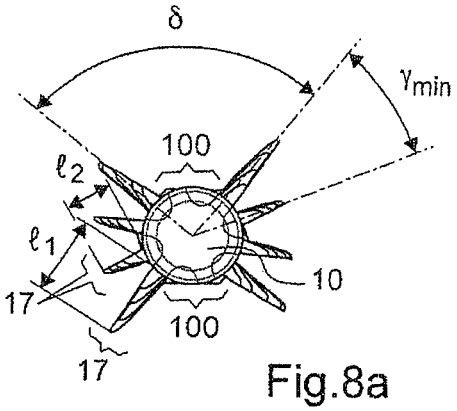

FIGS. 8 and 8*a* show the possibility of two consecutive rows having teeth of different respective lengths $l_1$ and $l_2$. A configuration in accordance with FIG. 8*a* may present two substantially-opposite toothless portions for example, each defined by rows of teeth of greatest length that is different from the greatest length of the teeth of their respective consecutive rows.

The core 10 may have a cross-section that is: circular, as shown in FIG. 9; elliptical, as shown in FIG. 9*a*; hexagonal, as shown in FIG. 9*d*; octagonal, as shown in FIG. 9*b*; or pentagonal, as shown in FIG. 9*c*.

Whatever the implantation of the teeth, at least one tooth may have a cross-section that is semi-circular, as shown in FIG. 10.

In a variant, the cross-section may be: circular, as shown in FIG. 10*h*; or even triangular, as shown in FIG. 10*e*; or lozenge-shaped, as shown in FIG. 10*a*; formed of two different-size adjacent triangles, as shown in FIG. 10*c*; hourglass shaped, as shown in FIG. 10*i*; or semi-hourglass shaped, as shown in FIG. 10*j*; or triangular with a groove, as shown in FIG. 10*d*; cross-shaped, as shown in FIG. 10*f*; square, as shown in FIG. 10*b*; semi-circular shaped with a groove, as shown in FIG. 10*g*.

The teeth are preferably of cross-section other than circular. A non-circular shape for the cross-section of the teeth may favor the retention of composition on the teeth.

In a variant embodiment, the longitudinal faces 15 of the core 10 are twisted, as shown in FIG. 11. In order to make such a shape, the core 10 may be deformed on unmolding by turning the endpiece 9, or, in a variant, it may be deformed in the mold.

The longitudinal axis X of the core 10 may coincide with the longitudinal axis Y of the stem 7, but it would not be beyond the ambit of the present invention for this to be otherwise, and, by way of example, FIG. 12 shows a variant embodiment in which the longitudinal axis X of the core 10 forms an angle $\beta_1$ with the longitudinal axis Y of the stem. By way of example, such a configuration may improve the ergonomics of the applicator.

The applicator may extend along a longitudinal axis X that is not rectilinear. FIG. 13 shows a variant embodiment in which the core extends along a longitudinal axis X that is curved. When observed in longitudinal section, as in FIG. 13, the envelope surface E may, on one side of the axis X, present a convex first profile 54 substantially in the same direction as the axis X, and, on the opposite side of the axis X, a second profile 55 that possibly presents curvature that is concave in the same direction as the axis X.

The envelope surface may be cylindrical, of non-cylindrical shape passing through a maximum or through two maximums.

In the variant shown in FIG. 13*a*, the envelope surface E presents two opposite longitudinal profiles 54 and 55, of which the profile 54 is straight.

In a variant, the envelope surface E may present a cross-section that passes through two maximums and one local minimum, as shown in FIG. 13*b*, or through one maximum, as shown in FIG. 13*c*.

In another variant, shown in FIG. 13*d*, the envelope surface E extends generally along a longitudinal axis W that forms an angle $\gamma_2$ with the longitudinal axis X of the core 10.

The FIG. 13*e* variant differs from the FIG. 13*d* variant in the shape of the envelope surface E that presents a cross-section that passes through a minimum.

The longitudinal axis X of the core 10 may be rectilinear and may form an angle with the longitudinal axis Y of the stem 7, as shown in FIG. 13*f*, the envelope surface E having, for example, a cross-section that is not constant, e.g. passing through a minimum.

In the variant embodiment shown in FIG. 14, the core 10 includes a recess in which there is engaged a support portion 60, e.g. made of metal or plastics material. The core 10 may be configured to be fastened to the support 60, or it may be free to turn or to move in translation relative to the support 60. By way of example, the core 10 may also be overmolded on the support 60.

The teeth of at least one row may present different lengths, passing through an extremum between the extreme teeth of the row, for example.

At least one of the teeth 18 of the rows 17 may present a surface state that is not smooth, e.g. having ridges as a result of molding or roughness linked to the presence of a filler in the plastics material, for example.

The applicator member may be made with a plastics material that includes magnetic particles. The magnetic field created by such particles, that may be magnetizable and/or magnetized, may interact with magnetic fibers or pigments that are present in the composition.

The applicator member may be made with flocking, said flocking extending over the teeth only or over the core only, for example.

At their free ends, the teeth may present portions in relief or of a particular shape, e.g. a fork, a hook, or a bead, as shown in FIGS. 15, 15*b*, and 15*a* respectively. By way of example, the hook may extend transversally, parallel, or obliquely relative to the longitudinal axis X of the core. In order to obtain the beads, it is possible to heat the applicator member in such a manner as to melt the ends of the teeth, for example. In order to obtain the forks or the hooks, it is possible to treat the applicator member mechanically, e.g. by grinding, and thus to abrade the ends of the teeth.

The wiper member may be made in some other way, e.g. it may comprise a block of foam that may be slotted. By way of example, the wiper member may also be as described in patent applications or U.S. patent Nos. 2005/0028834, U.S. Pat. Nos. 6,328,495, 6,375,374, 2004/0258453, and 2005/0175394, the content of which is incorporated herein by reference.

In particular, the wiper member may be rigid or it may be made out of elastomeric material.

The wiper lip 6*a* may advantageously be undulating, having a radially-inner free edge defining an orifice 122 through which the applicator member may pass, as shown in FIG. 16. The wiper lip 6*a* may include undulations 120 that extend around the orifice 122. The wiper member 6*a* may include a number of undulations 120 lying in the range 3 to 12, for example.

The wiper lip 6*a* may extend generally along a cone that converges towards the bottom of the container, and that has a generator line G forming an angle i with the axis X of the container. In a variant, the wiper lip 6*a* may extend generally along a mid-plane that is perpendicular to the axis X, or it may even extend generally along a cone that converges towards the outlet of the container.

The wiper member may also be adjustable, where appropriate.

The stem 7 to which the core is fastened may be flexible at least in part, and in particular it may be entirely flexible, e.g. in the proximity of the applicator member. By way of example, the stem may include at least one flexible element 80, as shown in FIG. 17, e.g. made of elastomer and/or presenting a shape that imparts flexibility, e.g. at least one notch 81 as shown in FIG. 17*a*.

In order to use the device 1, the user may unscrew the closure cap 5 and remove the applicator member 8 from the container 3.

After the applicator member 8 has passed through the wiper member 6, a certain quantity of composition remains between the rows 17 and between the teeth 18 of the rows, and in particular in the toothless portion(s) 100.

The applicator member may be made by any known method such as injection-molding, dual-injection-molding, and protrusion, in which material is injected through at least one portion of the core, so as to enable teeth to be formed.

The applicator member may be a vibrator member, i.e. vibration may be applied to the applicator during application, combing, or while taking the composition, e.g. as described in application WO 2006/090343.

Still in a variant, the applicator member may be rotary, i.e. it may be turned about the longitudinal axis of the core, e.g. during application, combing, or while taking the composition.

Still in a variant, the applicator member may deliver heat, i.e. it may include a heater element.

It is also possible that the applicator member may vibrate, turn, and heat, or merely vibrate and turn, or merely vibrate and heat, or merely turn and heat, or merely vibrate, or merely turn, or merely heat.

The applicator member may include any bactericidal agent such as silver salts, copper salts; preservatives; and at least one agent for preserving the composition such as parabens or other preservatives.

The core and/or the teeth may further include particles, e.g. a filler, in particular a magnetic, bacteriostatic, or humidity-absorbing compound, or even a compound for creating roughness at the surface of the tooth, or for encouraging sliding of the eyelashes over the teeth. At least one of the core and a tooth may be flocked, may receive any heat treatment or mechanical treatment, and/or may include particles, e.g. a filler, in particular for improving sliding.

Figure 2:
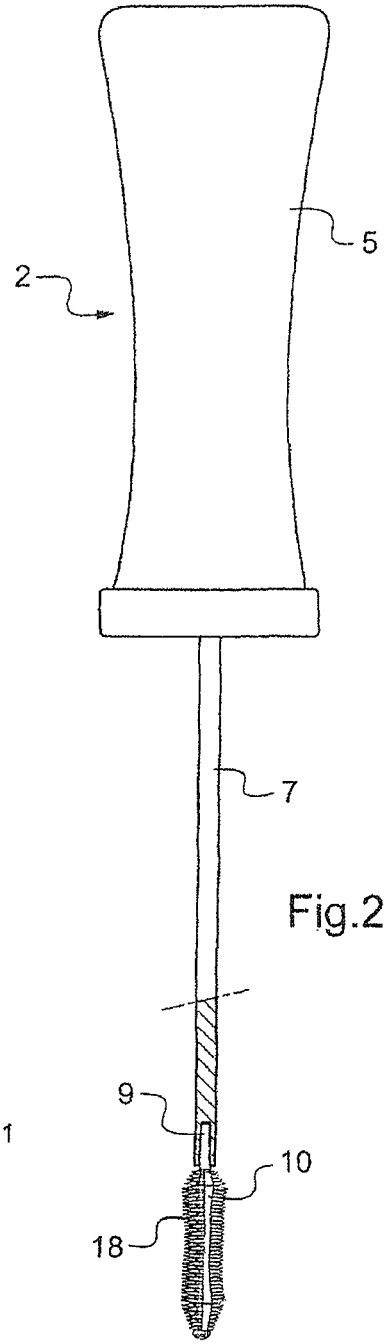
FIG. 2 is partially in longitudinal section, and shows the FIG. 1 applicator in isolation.

The packaging and applicator device may as shown in FIG. 1 comprise a container and an applicator device being able to be removed and unfastened from the container for applying the composition.

In not shown exemplary embodiments, the packaging and applicator device may comprise an applicator member fastened to the container and present inside said container before application. Said applicator member is able to be extracted from said container while still being fastened to it for applying the substance on the eyelashes and/or the eyebrows. Such an embodiment is described in FIG. 50 of WO 2009/153753, said figure being incorporated by reference.

In not shown exemplary embodiments, the applicator member is fastened to the container and may not able to be moved relative to it. The applicator member then comprises a canal and at least one hole on its outside surface. During application, the applicator member is fed by the substance to be applied through the canal and hole(s) opening out on the applicator member.

The above description of the applicator elements applies equally to any of these embodiments concerning the relation between the container and the applicator member.

Naturally, the invention is not limited to the above-described embodiments, the characteristics of which may be combined together within variants not shown.

The expression "comprising a" should be understood as being synonymous with "comprising at least one", and "lying in the range" should be construed as including the limits of the range, unless specified to the contrary.

The invention claimed is:

1. A packaging and applicator device for applying a composition (P) to the eyelashes and/or the eyebrows, the device including:

a container comprising a composition to be applied to the eyelashes and/or the eyebrows; and a molded applicator member consisting of:

a core having a longitudinal axis; and rows of teeth that are carried by the core, two teeth belonging to two consecutive rows not being parallel, the outside surface of at least one segment of the core including only two toothless portions that are situated substantially opposite each other, the or each toothless portion being of angular extent lying in the range 75° to 110° around said longitudinal axis, the applicator member being the only part of the applicator device that is configured for coming into contact with the eyelashes and/or the eyebrows.

2. A device according to claim 1, both of the toothless portions occupying 7% to 40% of the outside surface of said segment of the core.

3. A device according to claim 1, the angular extent of both of the toothless portions being a multiple that is equal to at least twice the minimum angular offset defined by the rows that are the closest together around the longitudinal axis.

4. A device according to claim 1, each of the rows of teeth having at least 50% of their teeth extending from the core in substantially radial manner.

5. A device according to claim 1, the molded applicator member including two rows of teeth situated substantially opposite each other that have longest teeth that are substantially of the same length.

6. A device according to claim 1, the minimum angular offset, defined by the rows that are the closest together around the longitudinal axis, being less than 60°.

7. A device according to claim 1, the applicator member being molded within a mold that is formed by assembling together a plurality of shells of which at least two consecutive shells having facing faces without cavities for forming teeth.

8. A device according to claim 1, said segment of the core having a length that is greater than or equal to 50% of the total length of the portion of the core carrying the teeth.

9. A device according to claim 1, the core presenting only two opposite faces without teeth over all or part of the length thereof.

10. A device according to claim 9, the two opposite toothless faces having, over all or part of the length thereof, a width that varies along the longitudinal axis of the core.

11. A device according to claim 9, at least one of the two toothless faces not being plane.

12. A device according to claim 1, the longest teeth of the applicator member having a length lying in the range 1 mm to 6 mm.

13. A device according to claim 1, the applicator member, when observed along the longitudinal axis of the core, not comprising teeth on only two portions that are situated substantially opposite each other, the or each toothless portion being of angular extent lying in the range 75° to 110° around said longitudinal axis.

14. A method of manufacturing a packaging and applicator device for applying a composition to the eyelashes and/or the eyebrows, wherein said device includes:

a container comprising a composition to be applied to the eyelashes and/or the eyebrows; and a molded applicator member consisting of:

a core having a longitudinal axis; and rows of teeth that are carried by the core, two teeth belonging to two consecutive rows not being parallel, the outside surface of at least one segment of the core including only two toothless portions that are situated substantially opposite each other, the or each toothless portion being of angular extent lying in the range 75° to 110° around said longitudinal axis, the entire surface of the toothless portion being able to come into contact with the eyelashes and/or the eyebrows, and the method comprising at least a step of molding the core and the teeth in a mold that is formed by assembling together shells, with at least two consecutive shells having facing faces without cavities for forming teeth.

15. A method according to claim 14, two groups of shells, situated substantially opposite each other, each including at least two consecutive shells having facing faces without cavities for forming teeth.

16. A method according to claim 14, the assembly comprising twelve shells.

* * * * *